US005991043A

United States Patent [19]

Andersson et al.

[11] Patent Number: 5,991,043

[45] Date of Patent: Nov. 23, 1999

[54] IMPACT POSITION MARKER FOR ORDINARY OR SIMULATED SHOOTING

[75] Inventors: Tommy Andersson; Hans Ahlen, both of Stockholm, Sweden

[73] Assignee: Tommy Anderson, Stockholm, Sweden

[21] Appl. No.: 09/101,273

[22] PCT Filed: Dec. 27, 1996

[86] PCT No.: PCT/SE96/01757

§ 371 Date: Aug. 12, 1998

§ 102(e) Date: Aug. 12, 1998

[87] PCT Pub. No.: WO97/25583

PCT Pub. Date: Jul. 17, 1997

[30] Foreign Application Priority Data

Jan. 8, 1996 [SE] Sweden ..... 9600069
Jun. 19, 1996 [SE] Sweden ..... 9602427

[51] Int. Cl.[6] ..... G01B 11/00

[52] U.S. Cl. ..... 356/400

[58] Field of Search ..... 356/375, 400, 356/138, 3; 434/12, 22, 20; 273/312

[56] References Cited

U.S. PATENT DOCUMENTS

| | | | |
|---|---|---|---|
| 3,964,178 | 6/1976 | Marshall et al. | 35/25 |
| 4,290,757 | 9/1981 | Marshall et al. | 434/12 |
| 4,470,817 | 9/1984 | Diehl et al. | 434/22 |
| 4,597,740 | 7/1986 | Stickel | 434/10 |
| 4,923,401 | 5/1990 | Marshall et al. | 434/22 |
| 4,963,096 | 10/1990 | Khattak et al. | 434/21 |
| 5,281,142 | 1/1994 | Zaenglein, Jr. | 434/19 |

FOREIGN PATENT DOCUMENTS

| | | |
|---|---|---|
| 195 19 503 | 12/1995 | Germany . |
| 358 727 | 8/1973 | Sweden . |
| 650 857 | 8/1985 | Switzerland . |
| WO 85/03118 | 7/1985 | WIPO . |

*Primary Examiner*—Frank G. Font
*Assistant Examiner*—Michael P. Stafira
*Attorney, Agent, or Firm*—Young & Thompson

[57] ABSTRACT

An impact position marker for ordinary or simulated shooting from a fire-arm (1) towards a moving target comprises a sensor part (2) with an evaluation unit for the actual position of the target in relation to the fire-arm and a firing detector. The evaluation unit comprises an image taking device (10) with its optical axis directed in parallel with the sighting line of the fire-arm (1), a unit (11) which measures the rotation of the sighting line of the image taking device in at least two planes at an angle to each other and comprises one and the same line coinciding or parallel with the sighting line of the fire-arm. The output signals from the image taking device (10), the rotation-measuring unit (11) and the firing detector (12) are inputted to an evaluation unit (13) which calculates the distance to the target and the position of the point of impact in relation to the target at the calculated impact moment. The result of the measuring is presented on a presentation unit (4) and/or controls an acoustic feed-back signal which assists the shooter during aiming and firing.

21 Claims, 3 Drawing Sheets

IMPACT POSITION MARKER FOR ORDINARY OR SIMULATED SHOOTING

The present invention relates to a impact position marker of the type which is given in the preamble of claim 1. More particularly, the invention relates to a device for inputting, calculating and presenting the result of target shooting against moving targets with shotguns or similar weapons. Impact position marker is intended for ordinary or simulated shooting from a fire-arm against a moving target and comprises a sensor part with an estimating unit for the actual position of the target in relation to the fire-arm, and a firing detector.

TECHNICAL FIELD

During shotgun shooting against clay pigeons, e.g. skeet and trap shooting, a hit is indicated by the clay pigeon being seen to break up. Even if it is possible to some extent to judge the quality of the hit from how powerfully the clay pigeon is fragmented, it is difficult with bad hits and with misses to get an exact idea of the impact position, i.e. the angular distance between the target and the charge of shot and whether the shot passed over, under, to the left or to the right of the target.

The possibilities of training for shotgun shooting are limited by the availability of shooting ranges which for environmental reasons are placed away from settlements. Other restrictions also sometimes limit the possibilities for training, for example, regulations about permitted shooting times.

These said conditions mean that there is a need for, on the one hand, an aid which shows the position of impact during (conventional) shotgun shooting, on the other hand, a system for training in shotgun shooting under simulated conditions, i.e. without live ammunition needing to be discharged.

DESCRIPTION OF RELATED TECHNOLOGIES

A number of systems for simulating shooting have been suggested in order to improve the possibilities of practising shooting with small arms, one of which is described in U.S. Pat. No. 5,194,006. This system permits shooting training in a simulator with small arms where an image of the target is projected onto a projection screen and the shooter fires towards the projected target with a gun simulator. The system calculates the impact position with reference taken to the angular speed of the target and a fictive distance. The system cannot be used for practice shooting against real targets.

A number of known systems, amongst which is the one described in U.S. Pat. No. 3,798,795, are known for estimating the results of shooting when shooting against true moving targets with ballistic projectiles. A necessary part of systems of this type is a distance measuring function. In this system a (TV) camera image is used for inputting the vertical and horizontal position of the target while the distance is determined with the help of measuring the delay time interval for a radio signal which is echoed by a transponder on the target. This method for measuring the distance is not suitable for clay pigeon shooting.

In the same way as with the evaluation afterwards of a shot which has been discharged, a fire control system which, before the shot is fired, must determine a suitable direction of aim, must determine the distance to the target. In U.S. Pat. No. 4,922,801 a fire control system for a weapon with a barrel directed by a shooter is described which assists the shooter during aiming by calculating the position for a "future" target. The position for the future target is calculated with reference to the angular speed of the target and the distance, and the delay time interval for the projectile, and is presented in the form of an aiming point which the shooter shall aim towards in order to hit. The distance to the target is calculated from the apparent size of the target on a TV image. The object of this system is fire control, not the evaluation of the result of shooting.

The English company Powercom (UK) Ltd sells a system called Lasersport Clay Pigeon Shooting System, which can be used for simulated shooting against specially manufactured clay pigeons. In order to detect hits, respectively misses, an infrared light beam with a dimension which corresponds to the width of a charge of shot is sent from the gun simulator. The light reflected from the target is used in order to decide if the "shot" was a hit or a miss. The system does not take account of aiming off-hit detecting takes place as if the speed of the shot was equal to the speed of light. This means that the system does not correctly simulate the conditions in clay pigeon shooting with shotguns, whereby it is not a usable training aid for clay pigeon shooting, which requires aiming off.

OBJECTS OF THE INVENTION

An object of the invention is during shotgun shooting and similar shooting against moving targets, above all clay pigeon shooting, to produce an impact position marker which calculates and presents the position of impact for discharged shots in relation to the direction of the target, so that the shooter can get an idea of the size and direction of the mis-aiming.

Another object of the marker according to the invention is to permit shoot training through the simulation of shotgun shooting against moving targets. The simulated shooting takes place under conditions which are identical with live shooting with shotguns, the only difference being that the weapon is not discharged. This means that the shooting can take place against clay pigeons which are thrown in the ordinary way and with the shooter's own weapon.

Yet another object of the marker according to the invention is to permit simulated shooting against a projector screen where moving targets are presented with the help of an image projector.

Yet another object of the invention is to produce a marker which on the one hand can be used for shooting against fictive targets but which also, without modification, can be used when shooting against real clay pigeons. The marker shall consequently be able to be used during shooting with live ammunition but also during shooting training in the form of simulated practice shooting for shotgun shooting or similar shooting.

Yet another object of the invention is to help the shooter correct an incorrect direction of aim through an acoustic signal.

Yet another object is to make it easier for the shooter during shooting, when the gun muzzle is successively moved nearer to a correct aiming point, to be acoustically or optically helped to fire at the right point of time.

A solution to the most of the above mentioned objects is given by the characterizing clause of claim 1. Further developments and further characteristics of the marker according to the invention are given in the dependent claims.

The impact position marker for ordinary or simulated shooting from a fire-arm against a real, moving target comprises a image recording device, e.g. a video camera, for determining the direction and distance of the target in relation to the fire-arm and its direction of aim.

The image recording device has its optical axis directed parallelly to the line of aim of the fire-arm. A rotation measuring unit, i.e. a gyroscope, measures the rotation of the line of aim of the image recording device in at least two planes at an angle to each other and comprising one and the same line corresponding or parallel to the line of aim of the fire-arm. The output signals from the image recording device and the rotation measuring unit are inputted to an evaluation unit which calculates the distance and direction to the target and the aiming point which, with reference to the necessary compensation for aiming off, would give a hit. The result of the measuring is presented on a presentation unit.

The system can be used essentially in three different ways:

against real, moving targets which are shot at with live ammunition;

against real, moving targets in connection with simulated shooting, i.e. practising of aiming and firing without the use of live ammunition;

during simulated shooting against a projection screen where moving targets are presented with the help of an image projector.

ADVANTAGES OF THE INVENTION

During live shooting the position of impact marker is an aid for finding the right aiming point and understanding which mistakes have been made during aiming and discharging.

Used as a simulator the position of impact marker is a training tool which permits effective and intensive shooting training at a low cost on ordinary shooting ranges and also in places where training shooting otherwise could not be performed.

When used in connection with live shooting the value of the training is increased through the shooter receiving better information on which mistakes have been made during shooting, e.g. mistakes in aiming off.

During use of the system for simulated training shooting it is possible to run training in places and at times which otherwise would not be possible. Compared with conventional clay pigeon shooting without aids, simulated shooting against real clay pigeons and also simulated shooting against targets on a projection screen can give a greater training effect through, on the one hand, the acoustic signal which indicates incorrect, respectively correct, aiming of the muzzle during firing, on the other hand, the indication of the impact position even for missed shots. Finally, simulator training can be run at a low cost through the cost of consumable material being considerably reduced.

The system is in the first instance intended for clay pigeon shooting, e.g. skeet and trap shooting. The system can be used in shooting and simulated shooting against clay pigeons of ordinary design without any special surface coating. During simulated shooting, clay pigeons of a more solid material than ordinary can be used to make re-use possible.

In simulator training against a projection screen no extra equipment apart from the projection equipment itself is required. The requirement on the projection equipment is that the target is presented with sufficient contrast and sharpness so that its position and, to the extent that the size of the target in the picture is used for determining the distance, size shall be able to be determined by the image recording device of the impact position marker, and, if there is a risk of interference between the image presentation frequency of the projector and the image frequency of the camera, synchronization between the projector and the camera.

During training in connection with use of real clay pigeons the system can be used both in daylight and in lower surrounding lighting conditions. In the latter case, when, on the first hand, the use of the system as a simulator is required, the target can be actively illuminated. In order to minimize the sensitivity to interference, in this case it is appropriate to use targets with a retroreflective surface coating.

During simulation of shotgun shooting against a movable target on the ground, clay pigeons can be replaced by a corresponding target surface of suitable size and surface coating which is placed in the centre of the target.

SHORT DESCRIPTION OF THE FIGURES

The invention is described below in more detail in the form of examples with the guidance of the accompanying figures, where FIG. 1 shows a block diagram of an embodiment of the complete device according to the invention, FIG. 2 shows a detailed block diagram of an embodiment of the invention, FIG. 3 shows a block diagram of an embodiment for calculating the position of impact.

DETAILED DESCRIPTION OF THE FIGURES

Figure 1:
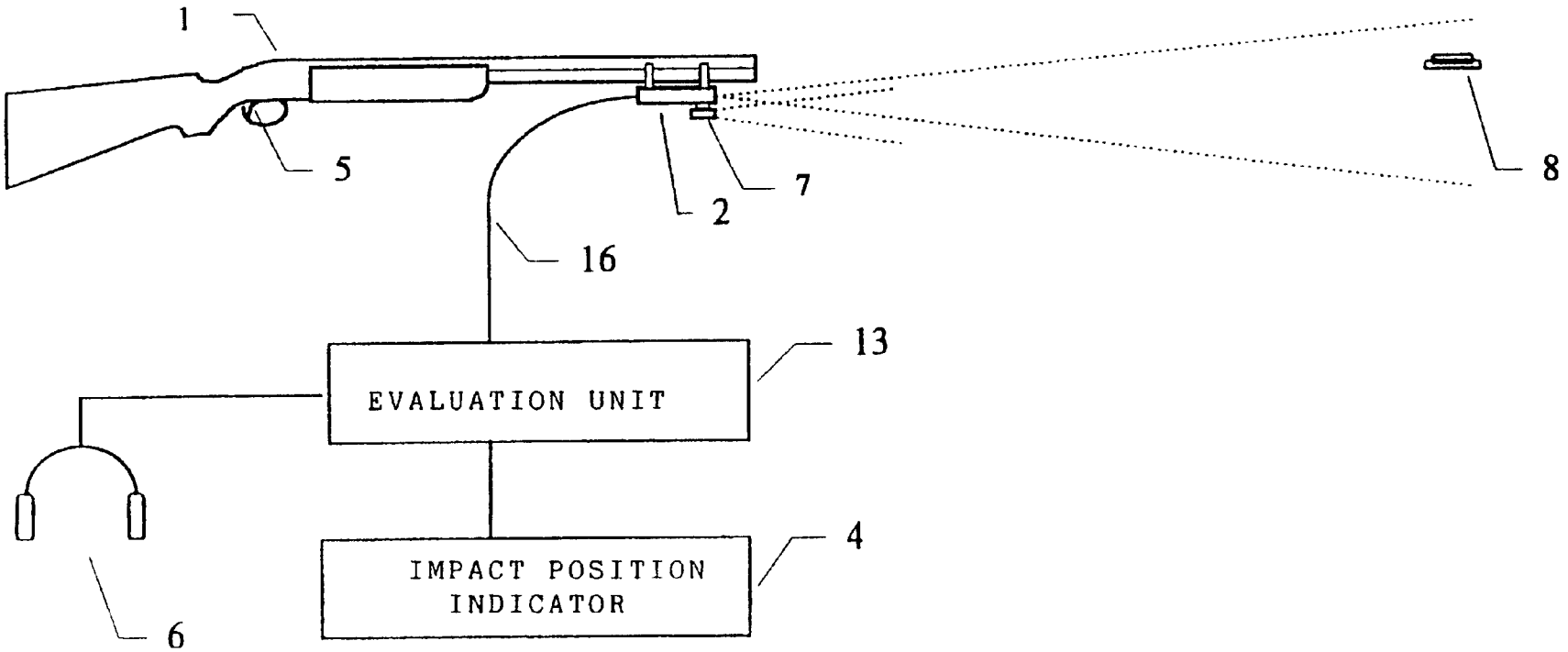
Figure 2:
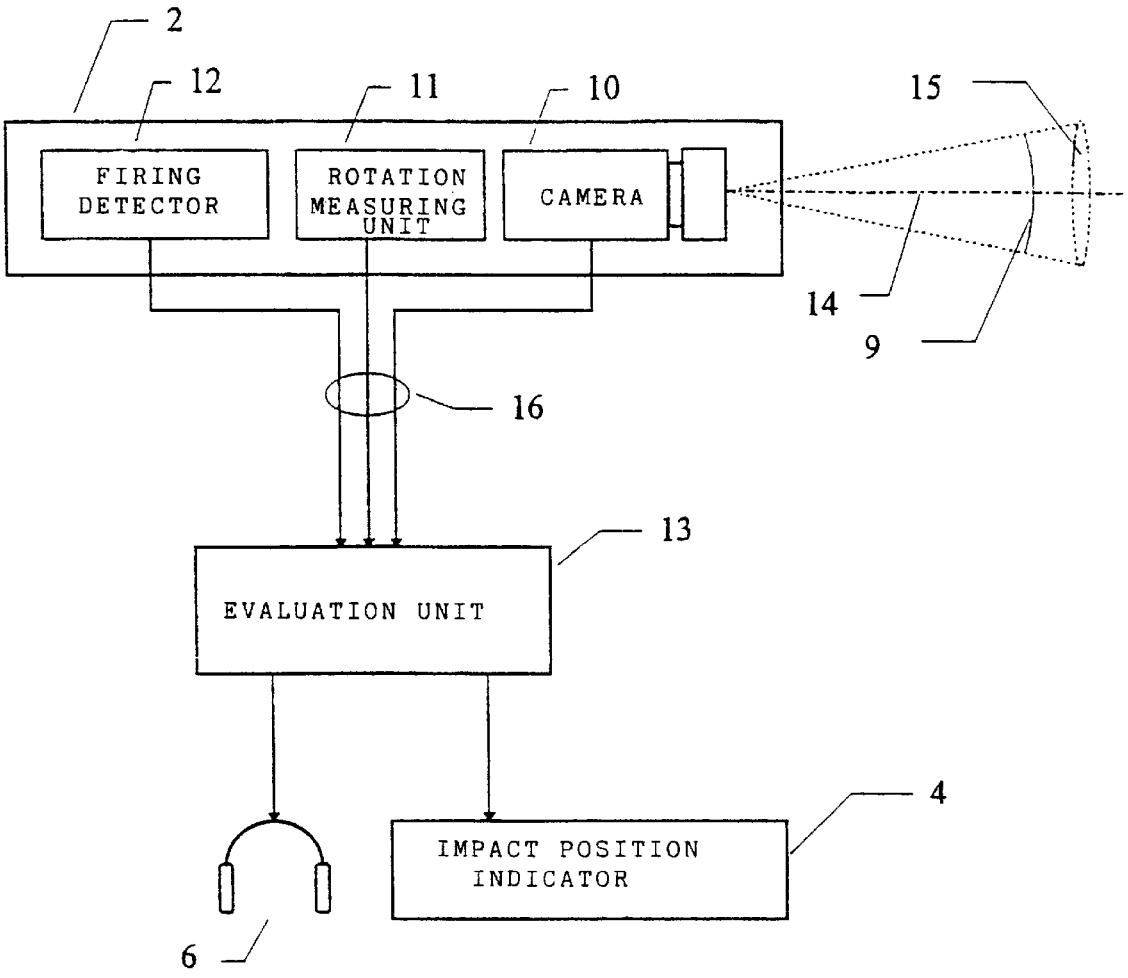

Referring to FIGS. 1 and 2, the impact marking device according to the invention comprises a measuring system for analyzing the position of impact on a target 8 in a target region 15 in front of a weapon 1, and means for presenting the point of impact for the shot. The mechanical design comprises a sensor part 2 which is mounted on the weapon 1, and an evaluation unit 13, which is connected to but can be physically separated from the sensor part 2. In order to communicate the result of the impact position calculation there is an impact position indicator 4 of which the physical placing in relation to the weapon can vary depending on which design is chosen. A more detailed description of the sensor part 2 and the impact position indicator 4 will be given below.

The need of a separate sensor part 2 and evaluation unit 13 is determined above all by the requirement for the smallest possible weight of the part which is applied to the weapon 1, i.e. sensor part 2. The weight of the evaluation unit 13 is, however, not so large, so that this part, if so desired, can be carried by the user and worn, for example, on a belt.

A number of alternatives can be conceived for the design of the impact position indicator 4:

graphic/numerical presentation on an indicator built in the evaluation unit;

acoustic indicating which informs about the position of impact by means of synthetic speech;

head-up-display, which generates a picture which can be overlayed on the visual impression obtained during aiming.

Combinations of these embodiments are also conceivable and suitable for simultaneously using both sight and hearing.

In order to increase the degree of the feeling of reality during simulated shooting, the system can include means for generating sound effects, e.g. a bang during firing, and means for simulating recoil.

The firing bang can be simulated with the help of a sound generator which produces a noise during firing.

Recoil can be simulated with the help of a device (not shown) which makes the weapon or the part of the butt which is in contact with the shoulder move backwards just like during the discharge of a live shot.

An acoustic feedback signal, which during aiming indicates if the weapon is aimed towards the correct aiming point in order to give a hit, and which also can comprise information on distance and direction between the actual aiming point and the correct aiming point, is called below "the hit signal". The part of the hit signal which contains information on the size and direction of the angular distance between the correct aiming direction (in order to hit) and the actual aiming direction is called below "the aiming signal", while the part of the hit signal which concerns a suitable firing time point is called "the firing signal". The aiming signal is suitably stereophonic and modulated so that by means of the sound it is possible to determine the relative distance between the aiming point which will give a hit and the actual aiming direction. Stereophonic sound requires two sound sources whereby it is suitable to use headphones, as is shown schematically by 6. The firing signal is an intermittent signal which sounds immediately before the correct aiming point has been reached. Through adapting the interval between the firing signal and the suitable time, so that it corresponds to the reaction time of the shooter, the shooter receives help in choosing the appropriate forward aiming off through, during successively increasing aiming off, firing when he hears the firing signal.

A head-up display for presentation of the impact position can be designed like a telescopic sight with a magnification of one, wherein graphic information can be overlaid on the visual impression.

When the system is used for shooting against real clay pigeons indoors and otherwise in low surrounding light, there can be a need for active illumination 7 of the target region in order to give the target a sufficiently large contrast against the background. This illumination 7 can either be placed on the weapon or on the sensor part, as is illustrated in FIG. 1, or in a fixed position at one side of the shooter.

Target Material

The calculation of the position of impact is based on the target being imaged by the camera with a sufficiently high contrast against the background for its position and, by means of the distance measuring according to method 1 below, its size to be able to be determined. This is true to the same extent for real clay pigeons as for filmed or synthetically generated ones which are shown on a projection screen. The targets 8 in the first instance are clay pigeons according to UIT's general and special rules. which, amongst others, are applied during international competitions. The diameter of the clay pigeons is 110 cm and the height 25–26 mm. Various colours are permitted, whereof one is orange-red and somewhat fluorescent. When reproducing in the blue part of the spectrum a clay pigeon against a clear or cloudy sky, this colour normally gives sufficient contrast for calculating the position of impact.

Normally designed clay pigeons with such a colour, can thus be used when the system is used in connection with live shooting. Nothing prevents the same type of target being used during simulated shooting. In order to reduce the cost of the consumption of clay pigeons in this type of use (if not before, clay pigeons often break during landing), clay pigeons manufactured in a more impact resistant material but otherwise with the same characteristics as normal clay pigeons, can be used in order to permit re-use.

Power Supply

During outdoor use, power supply can suitably be via batteries (not shown), whereby the system is totally self-sufficient and can be carried without the encumbrance of power supply cables.

FIG. 2

As can be seen from FIG. 2, according to the embodiment shown, the calculation of the position of impact is based upon the collection of data from in general three means in the sensor part 2:

- a camera 10 which continuously generates images of the target area in front of the weapon,
- a preferably twin-axis gyroscope 11 which registers the movement of the weapon, and
- a firing detector 12 for registering the firing.

The treatment of the received data and the calculation of the position of impact preferably take place in the evaluation unit 13.

Camera 10

Camera 10 is placed in the sensor part 2 so that the optical centre axis 14 of the camera is parallel with the direction of the muzzle of the weapon. The camera has the function of continuously generating images of a target region 15. Information from the camera is electrically transferred to the evaluation unit 13. The focal distance of the camera is dimensioned so that the field of view has such a size 9 that all hits during normal shooting in skeet and trap shooting can be detected. The maximal aiming off, which can be up to 5 degrees in this case, is a determining dimension for the field of view. The corresponding size of the field of view in this case is then 2×5 degrees=10 degrees. In order to be able to determine the position of impact during misses in combination with maximal aiming off, the field of view is suitably made larger, e.g. 15 degrees.

The spectral sensitivity of the camera is such that a target 8 is reproduced with the highest possible contrast against the background. The image frequency and line resolution are chosen according to the requirements set by the image-processing function, which is described in more detail below.

In order to compensate for varying environment light, the system comprises functions for automatic exposure control. As well as automatically varying the exposure time and possibly the aperture, in especially bright light in the environment a manual or automatically applied grey-filter can be used to reduce the requirement for varying the exposure time.

Gyroscope 11

The gyroscope 11 continuously measures the angular speed preferably in two perpendicularly orientated planes corresponding to the vertical and horizontal directions. A suitable design for this, with regard to the requirement of low weight, is the tuning fork gyroscope.

Firing Detector 12

The firing detector 12 has the task of detecting when the trigger 5 of the weapon is activated. A possible design is in the form of a microphone which picks up vibrations from the movement of the cock and the firing pin.

Signal Transfering

To the extent that the sensor part 2 is physically separated from the other units, transfering of signals to these units takes place via cable 16 or via telemetry to the evaluation unit 13.

Evaluation Unit 13

The evaluation unit 13 receives and analyzes the signal from camera 10, the firing detector 12 and the gyroscope 11. Its first task is to detect the target and calculate its direction and distance.

Two suitable embodiments of image processing for detecting the target object in the image (object extraction) are described below.

The first called "thresholding" below, is based on the analysis of colour respectively intensity of the elements comprised in the image. A suitable colour for clay pigeons is a fluorescent red colour. With a suitably chosen colour-sensitivity of the camera, this colour gives a strong contrast against the sky, which most often is blue or white. This colour is also the one which is judged to be the most suitable for use together with this system.

A monochromic camera sensible to blue light can be used. In that case a red clay pigeon is seen against the sky as a dark object. The target is thereby found by looking for image elements with a light level under a predetermined threshold value.

If another monochromatic colour is used, the evaluation unit 13 can instead localize the target in the image by looking for image elements with a light level above a predetermined light level. In comparison with the use of a colour camera, the use of a monochromatic camera gives a lower manufacturing cost but during reproduction of the target in strong sunlight from the side, it can, despite the spectral filtering, happen that part of the target is outlined with an intensity which is higher (or alternatively lower) than the threshold value. In this case the image would not correspond to the true shape of the target.

A colour camera with at least two different spectral regions, suitably one in the red and one in the blue region, gives considerably larger possibilities for correctly determining the shape of the target during illumination from the side of the target through the possibility of combining the pictures of the target in the different colours. In the red part of the spectrum the target appears lighter than (the blue or white) background, whereby the thresholding in this case is performed so that a search takes place for image elements or pixels which have a higher intensity than a certain threshold value, in order to find image elements which show the target. In the blue part of the spectrum, however, the search takes place for image elements which have a lower intensity than another certain threshold value. The complete image of the target is in this case achieved from the number of image elements which are comprised either in the blue or the red reproduction of the target or both.

In order to minimize the search space during object extraction and thereby the calculation requirements, the movement of the muzzle, the earlier position of the object, and the predicted next position are used, as will be made clearer below.

If the target stands out against an evenly lit background without sharp edges and contrasts. e.g. a cloud-free sky, the above described image processing technics are sufficient for localizing and determining the size of a target object with a high reliability.

If instead the background is patterned and has sharp contrasts, for example when reproducing trees or bushes which stand out against the sky, the said method alone normally does not give sufficiently large sensitivity to interference.

A second image-processing method which will here be described for the image analysis according to the invention is a complement to the one described above and uses the temporal dependence between successive images. During panning of the camera, both the background and the target will move in the image. By subtraction of successive images of the target area, the background can be eliminated and the moving target appear as the only object in the image. The subtraction is performed so that a pixel which corresponds to a certain point in the background in one image, is subtracted from a pixel in the next image which represents the same point. The movement of the background which occurs through the panning of the camera is compensated for through the image before subtracting being moved so that the backgrounds in the two images are levelled out. In this way the information on the muzzle, and (thereby the camera's) movement, which is received from the gyro signal, is used for determining the size and direction of said displacement.

The result from the image subtraction is images where stationary objects are suppressed and the moving target object appears. After this operation, image analysis according to the above, i.e. thresholding, takes place in order to detect the target object.

Compared with only using image information in order, with the help of pattern recognition, to determine by subtraction the displacement, the use of the gyro signal has a considerably lower requirement for processing capacity, which is an advantage of the method according to the invention.

CALCULATIONS

Aiming Off

One of the difficulties of shotgun shooting against moving targets is to bring about a suitable aiming off, i.e. to fire in the direction where the target will be at the time when the charge of shot has come to the path of the target. The size of the aiming off is determined by the travelling time of the charge of shot and the apparent angular speed of the target according to the following equation:

$$V_f = t_b \times S_m$$

where $V_f$=aiming off angle (rad)

$t_b$=path time (travelling time of the charge of shot (sec))

$S_m$=target speed (rad/sec)

The necessary aiming off is achieved by the shot being discharged at a suitable angle in front of the target 8. The technique which experienced shooters often use in order to get the biggest possible precision in aiming off is called shooting with overtaking swing, which means that the shooter lets the line of aim of the weapon follow the path of the target with an angular speed which is greater than the speed of the target. The effective aiming off is then found through the sum of 1) the aiming off, which the shooter experiences when he fires, and 2) the delay between the conscious decision of the shooter to pull on the trigger and the firing instance, i.e. the time when the charge of shot leaves the muzzle. Shooting techniques and thereby the swing can, however, vary, whereby the calculation of the position of impact must take place in a way which is independent of the shooting technique.

Calculation of the Position of Impact

The calculation of the position of impact is based in the evaluation unit on information about the direction of the gun barrel during firing, i.e. the direction of the shot, and extrapolation of the movement of the target after firing up to the calculated impact time. If the target is to be a hit, the direction of the target must cross the direction of the shot at the impact time.

The Movement of the Target

The position of the target at the calculated impact time is calculated through extrapolation of its movement in both of two perpendicular planes after firing. During flight the target follows a path which is a function of the starting speed, the starting direction, the acceleration of the earth and aerodynamic forces which depend amongst other on the path angle of the clay pigeon.

The extrapolation of the movement of the target takes place under the simplified assumption that the path of the target describes a great circle around the shooter and that the angular speed is constant during the path time. Calculation errors which can occur in this case are insignificant. The accelerations which are the actual case, the acceleration of the earth and the braking because of air resistance, and the geometric error by the assumption of a target path being in the shape of a great circle, have no practical significance because of the relatively short path time.

The following equation describes how the position of the target is extrapolated after firing for each of the two perpendicular coordinate axes.

$$\text{Direction}_{Target.impact\ time}=\text{Direction}_{Target.firing}+V_m\times\text{Path time}$$

where $\text{Direction}_{Target.impact\ time}$=the direction of the target at the calculated impact time, $\text{Direction}_{Target.firing}$=the direction of the target at firing, $V_m$=the absolute angular speed of the target, Path time=the flight time for the charge of shot from firing to the calculated impact time.

In addition to the direction of the target, the absolute angular speed of the target must be known. This is calculated as the sum of the angular speed of the target in relation to the aiming direction, i.e. the direction of the camera, and the angular speed of the barrel. In order to be able to calculate the latter, means of the gyroscopic type are included in the impact position marker.

A further requirement for the impact position calculation is a value for the path time for the ammunition, which for a certain type of weapon and ammunition simply can be determined by the distance. The distance is calculated by the evaluation unit, wherein two different calculating methods can be used.

Calculation method 1: The method for calculating the distance is, according to this method, based on the fact that the target, of which the absolute size is known, is imaged with a camera, wherein the size of the target in the picture plane of the camera together with information on the optics of the camera are used in order to determine the distance.

Calculation method 2: If information on the spacial coordinates of the target range and the place of the shooter during the actual shot have been stored in advance so that they are available to the evaluation unit, the distance can be calculated as a function of this information as well as the angular speed of the target seen from the shooting position.

The impact position indicator 4 and the impact signal generator 6 can either be individual physical units or can be included in the evaluation unit.

After a shot has been discharged the position of impact, i.e. the spacial angular distance in the vertical and horizontal planes between the target and the point where the shot passes through the plane of the path of the target, is calculated and presented. In addition to the position of impact, other measured values can also be presented, for example the direction of the shot and the movement of the aiming point relative to the target before firing. All relevant factors are taken into account during calculation of the position of impact, including delays in the weapon, the distance to the target, the flight time for the charge of shot to the target (path time), and the movement of the target during the path time.

The resulting position of impact is continually evaluated by the evaluation unit 13 during aiming. The result of this continuous evaluation can be used in order to control an output means, below called a "hit signal generator", which assists the shooter in choosing the aiming direction and suitable firing time. Information from the hit signal generator can be an acoustic signal which is modulated in such a way that the user can by listening decide if the shot with the chosen aiming direction will be a hit or a miss and, with a predicted miss, also determine how the aiming direction should be corrected.

In outdoor clay pigeon shooting ranges, because of the current regulations in certain branches, there are predetermined throwing paths for the clay pigeon in relation to the shooter at different stations. This means that the throwing paths can be pre-programmed and stored in the evaluation unit 13. In this case, all the shooter has to do is to state at which station on the range the shooter is, for example by pressing on one or several press buttons (not shown), whereafter the evaluation unit 13 performs the calculations with the help of the programmed-in target path.

The hit signal generator 6 is controlled with a signal which varies in accordance with the result of the calculated position of impact. In addition to the simple modulation principle that the signal sounds if, with the actual aiming of the barrel, there will be hit (i.e. with a certain degree of certainty will break up the pigeon) and otherwise is not heard, other more advanced modulation principles can be used which makes it possible to determine the degree of correct aiming towards the right aiming point and even the direction of the error. Aiming which would lead to the shot passing to the left of the target thereby sounds in a certain way which can be differentiated from other aiming mistakes. In order to maximize the use of the ability of the sense of hearing to determine direction, the hit signal can be generated as a stereophonic sound, whereby modulation of the strength of the sound, phase difference between left and right channels and the frequency content can be used in order to indicate whether the shooter is aiming too low, too high, to the left, or to the right of the target, as well as the size of the misaiming.

The acoustic signal can thus help the shooter to choose the correct aiming direction for a certain shot, but has also the object of giving an improved training effect through the shooter being able to couple together a certain visual impression of the target and its position and movement during aiming with an acoustic "feed-back" signal which indicates that this is the right aiming direction.

A First Embodiment for Determining Distance (with image processing)

Determination of distance based on the size of the target:

The distance is calculated on the basis of the camera image of the target. As the true size of the target is known, the distance of the target can be calculated as a function of the size of the target on the image surface and the focal length of the camera according to the following equation:

$$D=(dia_{target}/dia_{image})\times f$$

D=distance to the target $dia_{target}$=the true diameter of the target $dia_{image}$=the diameter of the target in the image f=the focal length of the camera The determination of the diameter of the target in the image is performed along the longest axis, which for an ordinary clay pigeon is 110 mm. In this way the influence of the orientation of the target, which can vary, is eliminated.

The distance measuring function according to this alternative puts a requirement on the resolution of the image, which consequently is chosen such that the accuracy requirement for measuring the distance is fulfilled.

The distance measuring function is activated as soon as a target object is identified and is performed on all the images up to the firing. Out of this series of measured values which are then normally collected, the average value is calculated from a suitable number of the last values before firing. In this way the influence of spread in the measured values caused by variation as a consequence of the quantizing of the pixels, the out-of-focus caused by movement, etc., is reduced.

The following will be stated about the methods which can be used for calculating the size of the target and thereby its distance:

The pixels in the image are searched in several passes in different directions until a threshold is passed. The searching can be performed with several threshold values in order to increase the measuring accuracy. The greatest distance between the passages through the threshold gives a measure of the size.

The measuring of the size can be performed by determination of the second derivative's zero transition which describes the edge of the object. The search then takes place for the largest distance between the zero transitions. The position of the zero transition is determined by linear interpolation in order to increase the accuracy in the measuring. The operation is performed on an image with pixels of which the intensity is given with a resolution which gives a grey scale. The edge of the clay pigeon is defined by the inflection point in the gray scale which is the point where the second derivative is equal to 0. This zero transition does not have to lie on a pixel but its spacial position is given by surrounding intensity values. The distance between the zero transitions at the respective edges of the clay pigeon is a measure of the projected size of the clay pigeon. The inflection point can be subpixel-interpolated as follows: if the second derivative for pixel No. i is equal to 10 and for pixel No. i+1 is equal to minus 15, the position for the zero transition is defined as $$i+10/(10-(-15))=i+0.4.$$

This type of interpolation increases the accuracy in the calculation of the projected size and thereby the accuracy in the calculation of the distance.

In determination of the direction of the shot, the distance information from several consecutive images is integrated and fitted to a likely throwing path.

If the target moves in the field of view in the camera during exposing of an image, an unsharpness is caused by the movement which is proportional to the speed of movement and the exposure time. The unsharpness caused by movement causes the image to be reproduced more or less out of focus in the direction of movement. The method for calculating the size of the target includes a minimizing of the unsharpness caused by movement based upon a calculation thereof, which is based on the speed of the target in the field of view calculated from the movement of the target from image to image as well as the exposure time.

In addition to said method for determining the size of the target, an alternative method can be used, based upon so-called correlation against a reference, whereby the target in the image is compared with a number of reference objects. Correlation over a certain level gives the size of the object.

A Second Embodiment of Determining Distance (based upon the path of the target)

If the spacial coordinates of the path of the target relative to the shooting position are known as well as the linear starting speed of the target, the distance can be unambiguously calculated as a function using only the angular speed and direction of the target.

The angular speed of the target can be calculated as the sum of the rotational speed of the barrel (which is received from the gyro signal) and the angular speed which corresponds to the movement of the target in the camera image. This method for measuring distance can be used for e.g. skeet shooting, where the path of the target is determined in advance. Before the shot is fired the actual parameters for the path of the target are given, for example by inputting the reference of the shooting station from which shooting shall take place. The reference of the shooting station can be automatically translated by the evaluation unit into the two paths of the target which can be actual for a certain shooting station and which correspond to the throw from either of the two clay pigeon throwers. Which of these two paths for the target which is actual for a certain shot is evident from the rotational direction of the barrel and therefore does not need to be indicated by any separate inputting. The analysis of the image information is reduced in this case to determination of the position and speed of the target object; the size of the target does not need to be evaluated as this is not needed for the calculation of the distance.

The measuring of distance based upon earlier inputted information on the path of the target, gives a lower demand on the image quality and a simpler image-processing.

Impact Position Calculating

During firing the information on the direction and distance of the target stored before the firing are used for extrapolating the continued movement of the target up to the point in time when the charge of shot would have reached or, in the case of a miss, passed the target. This extrapolated direction is compared to the direction of the shot, i.e. the direction of the barrel at the moment of firing. In order to be able to extrapolate the absolute movement of the target, the information from the gyroscope signal on the rotational speed of the barrel (and the camera) is used in order to create a fixed reference direction. For a hit, the direction of the target at the impact time-point (within a certain error margin) must correspond to the direction of the barrel at the moment of firing. The difference between these two directions is caused by mis-aiming the size and direction of which is indicated by the impact position indicator after calculating by the evaluation unit.

Figure 3:
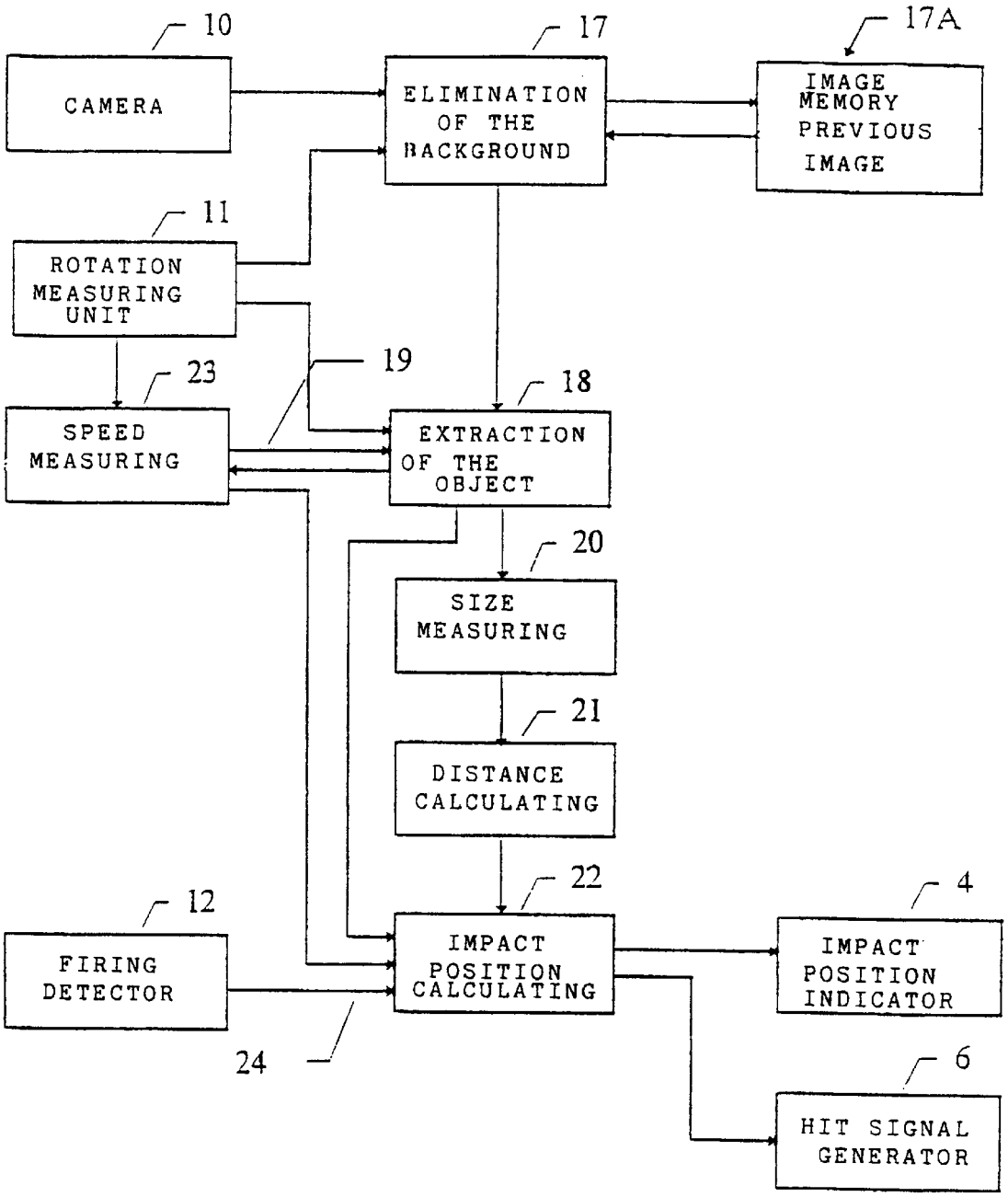

Flow Diagram in FIG. 3

FIG. 3 is a flow diagram for the function of the evaluation unit, when the first embodiment of the determination of the distance is performed. The input signals are a continuous series of camera images from camera 10 and a signal from the gyroscope 11, which gives the state of the movement of the barrel concerning rotation in the vertical and horizontal directions. The output signal is the impact position and an acoustic hit signal.

Elimination of the background takes place in block 17, wherein the image is compared to a previous image stored in an image memory 17*a*. Its output signal is a filtered video image which in block 18 is analyzed for extraction of a possible target object. In addition to the video image from block 17 the measured values for the movement of the barrel from the gyroscope 11 are used as well as a predicted next position 19 as input signals to 18. After processing in the next block 20, which performs the size measuring, and in block 21, which performs the above described distance calculation, the calculated distance forms an input signal to a block 22, where the impact position calculation takes place.

The input signal to 20 from the block 18 is a segment of the complete camera image which shows the extracted object and its immediate surroundings.

The processing in block 22 is a prediction of the position of the target object at the calculated time of impact. The signals which are used in this case are, in addition to the distance which is received from block 21, a signal 24 which states whether the trigger has been activated, and the position and speed of the target object, which latter two are received from a block 23 which performs a speed calculation with the guidance of a position output signal from block 18 and the signal from the gyroscope 11 concerning the movement of the barrel of the weapon.

The output signal from block 22 is used for controlling the impact position indicator 4 and the hit signal generator 6.

Calibration of the Position of Impact Calculation

In order for the calculation of the position of impact to give a result which corresponds to the true position of impact, the aiming line of the system, i.e. the direction which is presumed to be the direction of the shot, must correspond to the true direction of the shot. During shooting with live ammunition this correspondence can be performed so that, after mounting of the camera on the weapon, a special calibration shooting is performed, whereby one lets the camera take a picture of the charge of shot which in an early part of the shot lies in the shot container which at the same time forms the wadding. The exposure of the camera is controlled by the firing in such a way that an image of the discharged shot container is obtained before its direction has deviated from that of the charge of shot because of the air resistance. The direction of shot can then be deduced from the position of the discharge shot container in the image.

During determination of the direction of shot vertically, a compensation is made for the parallax which occurs because of the central axis of the camera not corresponding to that of the barrel. Calibration can, as mentioned, take place during a special firing which precedes the normal use, but can also be a part of the normal functioning at each shot. The advantage of the latter solution is that small displacements of the camera position can be tolerated during the shooting without deteriorated precision of the impact position calculation. In this way the requirements for mechanical stability in the fastening of the camera part to the barrel are reduced, which is an advantage.

Position of Impact Indicator 4

The position of impact indicator 4 shall give the result of the last fired shot to the shooter. Besides the position of impact, i.e. the size and direction of the mis-aiming, the indicator can also inform about the measured shooting distance as well as on how the target following has taken place, e.g. the relative speed between the line of sight and the target. The impact position indicator 4 can be either a separate physical unit or be joined together with the evaluation unit 13. A number of alternatives can be conceived for the design of the indicator:

graphic/numerical presentation on an indicator e.g. of the LCD type built together with the evaluation unit 13:

acoustic indication which gives the position of impact by means of synthetic speech;

an indicator which is placed so that during aiming the shooter sees the image from the indicator superimposed on the target area. The indicator shows the position of impact so that the shooter sees the direction of the charge of shot at the impact moment in relation to the true target. In the latter case the image is reflected from an indicator via a half-transparent mirror in a sighting means placed in the line of sight of the eye of the shooter (not shown but an arrangement which is wellknown to the person skilled in the art of head-up displaying). The image on the indicator, which at the hit moment, alternatively when passing the target, shows the position of the charge of shot, overlayed on the visual impression from the target region and gives the shooter a visual impression similar to that which is received during the use of tracer ammunition.

In addition to the result of the shot being presented in the form of a measurement of the size of the mis-aiming, the position of impact indicator can calculate the likely-hood that the shot was a hit or a miss, in which case the design is suitably so that the parameters which control this calculation, above all the bore of the barrel of the weapon, can be varied by the user in order to correctly reflect the actual conditions.

Hit Signal Generator

The analysis of the images received from the camera takes place continuously. Amongst the results which are received from each such analysis is a measured value of the position of impact which would have been achieved if the firing had taken place at a certain given point of time in relation to when the image was exposed. By extrapolation of the position of the target, the calculation is made to be valid for the position of impact for a shot which is fired a certain time increment in the future. If the time interval is chosen so that it exactly compensates for the reaction time of the shooter, the shot will be certain to hit if the shooter follows the target so that the direction of the shot crosses the path of the target at the calculated impact time and fires just when he hears the hit signal.

| | |
|---|---|
| FIG. 1 | Evaluation unit: |
| | Position of impact indicator |
| FIG. 2 | Firing detector |
| | Rotation-measuring unit |
| | Camera |
| | Evaluation unit |
| | Position of impact indicator |
| FIG. 3 | Camera |
| | Elimination of the background |
| | Picture memory previous picture |
| | Rotation-measuring unit |
| | Speed measuring |
| | Extraction of the object |
| | Size measuring |
| | Distance calculating |
| | Firing detector |
| | Position of impact calculating |
| | Position of impact indicator |
| | Hit signal generator |

We claim:

1. Impact position marker for ordinary or simulated shooting from a fire-arm (1) towards a moving target, comprising a sensor part (2) with an estimating unit for the actual position of the target in relation to the fire-arm and a firing detector, characterized in that the estimating unit comprises an image taking device (10) with its optical axis directed parallel to the line of sight of the fire-arm (1), and that a unit (11) is arranged which measures the rotation of the line of sight of the image taking device in at least two planes at an angle to each other and comprising one and the same line coincident or parallel with the line of sight of the fire-arm, and that the output signals from the image taking device (10) and the rotation-measuring unit (11) and the firing detector (12) are fed to an evaluation unit (13), which at least calculates the distance to and the deviation from the line of sight from the correct line of sight for hitting the target, and a hit result unit (14) for giving an indication of the hit result.

2. Image position marker according to claim 1, characterized in that the image of the target is arranged to be extracted out of the image taken with the image taking device (10).

3. Impact position marker according to claim 2, characterized in that the image taking device (10) is monochromatic and colour-adjusted in order to give a large contrast between the target and the sky, and that the evaluation unit (13) localizes the target in the image by looking for image elements with a light level under or above a predetermined light level, dependent on the colour adjustment.

4. Impact position marker according to claim 2, characterized in that the image taking device (10) is colour-adjusted for only a small number, e.g. two, of discrete colours, and that the evaluation unit (13) determines the position and size of the target in the image for at least one of the colours by looking for image elements with a light level under a predetermined first light level for that colour and for at least one other of the colours by looking for image elements with a light level above a second predetermined light level for that colour, and generates the complete representation of the target by a combination of the searches in the different colours.

5. Impact position marker according to claim 2, characterized in that the evaluation unit (13) calculates the displacement of the background between different images with the guidance of signals from the rotation-measuring unit (11) and discriminates away the background by subtraction of the images with reference taken to eventual image displacement caused by panning of the image recording device between each pair of pictures taken.

6. Impact position marker according to claim 1, characterized in that the evaluation unit (13) determines the distance to the target with the guidance of the true size of the target, the size of the target in the image and the focal length of the image taking device.

7. Impact position marker according to claim 1, characterized in that the evaluation unit (13) determines the distance to the target by searching the image of the target, image element by image element, and comparing the object in the image with one or more previously stored reference objects, wherein correlation over a certain threshold gives the position and size of the target.

8. Impact position marker according to claim 1, characterized in that the evaluation unit (13) determines the distance to the target with the guidance of previously stored information on the spatial coordinates of the shooting range and the position of the shooter at the time of the actual shot, and calculates the distance to the target as a function of this information and the angular speed of the target seen from the firing position.

9. Impact position marker according to claim 1, characterized in that the evaluation unit (13) calculates the absolute angular speed of the target as the sum of the rotational speed of the weapon barrel received from the rotation-measuring unit (11) and the angular speed of the target which corresponds to the movement of the target in the image from the image taking device.

10. Impact position marker according to claim 1, characterized in that the evaluation unit calculates the aiming off on the basis of information on the distance to the target and of the absolute angular speed of the target.

11. Impact position marker according to claim 1, characterized by means for generating effects to simulate a realistic shooting experience in the case of simulated shooting, for example sound effects, such as the bang during firing activated by a trigger (5) on the weapon (1) and/or simulating the recoil by a mechanical device which simulates the movement of a weapon during firing.

12. Impact position marker according to claim 1, characterized by an acoustic means (6) for producing an acoustic feed-back signal, which during aiming indicates whether or not the weapon is aimed towards a correct aiming point in order to give a hit.

13. Impact position marker according to claim 12, characterized in that the sound from the acoustic means (6) at mis-aiming is modulated so that the shooter hears in which direction (vertically and horizontally) the direction of aiming is to be corrected in order to hit the target.

14. Impact position marker according to claim 13, characterized in that the acoustic means is arranged to give a mono- or stereophonic signal so modulated that the character of the sound shows the relative distance between the aiming point which would give a hit, and the actual direction of aiming.

15. Impact position marker according to any of claim 12, characterized in hat the acoustic means (6) comprises two sound sources, e.g. headphones, in order to give a stereophonic sound controlled by the evaluation unit (13).

16. Impact position marker according to claim 1, characterized in that the hit result unit (4) comprises a head-up display combined with an aiming means on the weapon, which head-up display generates an image which is overlaid on the visual impression which is received during aiming.

17. Impact position marker according to any of claim 1, characterized in that the hit result unit (4) comprises a graphic/numerical presentation on an indicator built together with the evaluation unit (13).

18. Impact position marker according to any of claim 1, characterized in that the hit result unit (4) comprises an acoustic indicator which indicates the impact position by means of synthetic speech.

19. Impact position marker according to claim 1, characterized in that the impact position indicator (4) evaluates the impact position continuously while the shooter is aiming the weapon (1) towards the target (8) and controls output means which informs the shooter of a suitable opportunity to fire.

20. Impact position marker according to claim 19, characterized in that the output means give an acoustic signal which sounds just before the suitable firing time, wherein the time interval between the acoustic signal and the suitable firing time is adapted to correspond to the delay dependent on the reaction time of the shooter.

21. Impact position marker according to claim 1, characterized in that a firing detector is arranged so that the sound from the cock and the movement of the firing pin are detected by a microphone the signal of which after suitable processing forms an indication of firing and is sent to the evaluation unit.

* * * * *